United States Patent [19]

Stern

[11] Patent Number: 4,819,677

[45] Date of Patent: Apr. 11, 1989

[54] CONTAINER FOR HAZARDOUS DETERGENTS

[76] Inventor: Leif E. Stern, Fattershus S-225, 90 Lund, Sweden

[21] Appl. No.: 89,529

[22] Filed: Aug. 26, 1987

[30] Foreign Application Priority Data

Sep. 9, 1986 [SE] Sweden ..... 8603759

[51] Int. Cl.[4] ..... B08B 3/04

[52] U.S. Cl. ..... 134/104.2; 134/166 R; 134/155; 134/186; 220/402; 220/403; 141/114; 141/98; 222/108

[58] Field of Search ..... 134/99, 102, 104, 105, 134/166 C, 169 C, 200, 201, 155, 186; 239/106, 112; 55/320, 441, 468; 118/302; 222/92, 94, 108; 141/59, 114, 98; 220/22.1, 402, 403; 137/312; 51/424

[56] References Cited

U.S. PATENT DOCUMENTS

| | | | |
|---|---|---|---|
| 2,481,813 | 9/1949 | Bede | 118/302 X |
| 3,179,341 | 4/1965 | Plos et al. | 239/112 X |
| 3,450,092 | 6/1969 | Kock | 239/112 X |
| 4,163,523 | 8/1979 | Vincent | 239/112 X |
| 4,487,367 | 12/1984 | Perry | 239/112 |

FOREIGN PATENT DOCUMENTS

| | | | |
|---|---|---|---|
| 872653 | 6/1971 | Canada | 239/112 |

*Primary Examiner*—Harvey C. Hornsby
*Assistant Examiner*—Frankie L. Stinson
*Attorney, Agent, or Firm*—Tarolli, Sundheim & Covell

[57] ABSTRACT

The present invention relates to a container for hazardous detergents which is adapted to permit withdrawal of the hazardous detergent (73) and recovery thereof in polluted state, the hazardous detergent (73) preferably being a solvent which can be pumped out of the container (9), is useful for internal and/or external cleaning of spray guns (1) or other polluted implements and recoverable in the container (9) in polluted state. To allow disposal of the container in cramped spaces and to eliminate the risk of explosive and/or toxic gases collecting therein, the container is characterized in that it comprises an outer container (64) and an inner container (66), that there is connected to the inner space (65) of the outer container (64) and possibly to the inner space (72) of the inner container (66) a pump device (75 and possibly 79) for pumping up clean detergent (73) from the inner space (65) of the outer container (64) and possibly the inner space (72) of the inner container (66), that there is connected to the inner space (72) of the inner container (66) a return conduit (29) for recirculating detergent (73) coming from the outer container (64) and possibly from the inner container (66) and polluted through use, to the inner space (72) of the inner container (66), and that the inner container (66) has flexible walls to permit unfolding and/or distention thereof as the outer container (64) is drained of clean detergent (73) and the inner container (66) is filled with polluted detergent (73). (FIG. 3).

8 Claims, 6 Drawing Sheets

CONTAINER FOR HAZARDOUS DETERGENTS

This invention relates to a container for hazardous detergents which is adapted to permit withdrawal of the hazardous detergent and recovery thereof in polluted state, said hazardous detergent preferably being a solvent which can be pumped out of the container, is useful for internal and/or exteral cleaning of spray guns or other polluted implements and recoverable in the container in polluted state.

In cleaning processes using detergents and the recovery of polluted detergents use is made of two separate containers, namely one container holding clean detergent and another for recovery of the polluted detergent. However, the necessity of using two separate containers gives rise to some problems. Thus, two separate containers will have to be placed at each cleaning site; it is often difficult to place the two containers in the cleaning installations since these are cramped for room; and when one container has been drained of detergent, hazardous and possibly explosive gases remain, which calls for special carefulness for the prevention of accidents.

The object of the present invention int.al. is to eliminate these problems and to provide a container which permits both discharge and recovery of detergent, is readily accommodated in customery cleaning installations and is not drained such that hazardous or explosive gases will be left. This is brought about by means of a container having the characteristic features appearing from appendant claim 1.

By reason of the fact that the container according to the invention comprises an outer and an inner container, the total number of separate containers can be reduced by half and this also applies to the space occupied by the container in transport. The container is readily accommodated in existing installations and one part thereof is filled concurrently with the draining of the other part thereof, which implies that there are not formed any empty spaces containing dangerous gases.

The invention is elucidated more in detail below with reference to the accompanying drawings. In the drawings.

Figure 1:
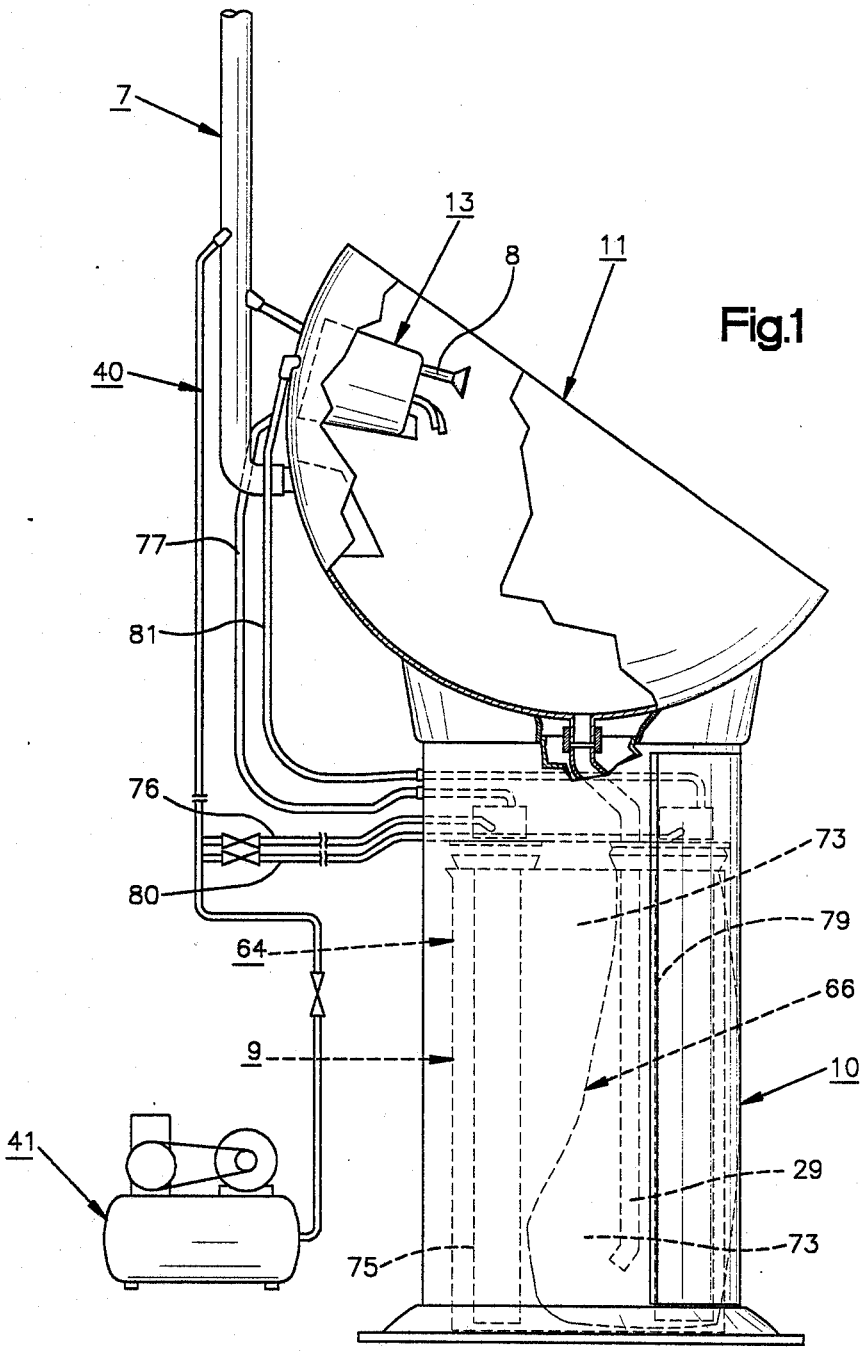
FIG. 1 is a side view showing a device for cleaning spray guns, which is provided with a container according to the invention.
Figure 2:
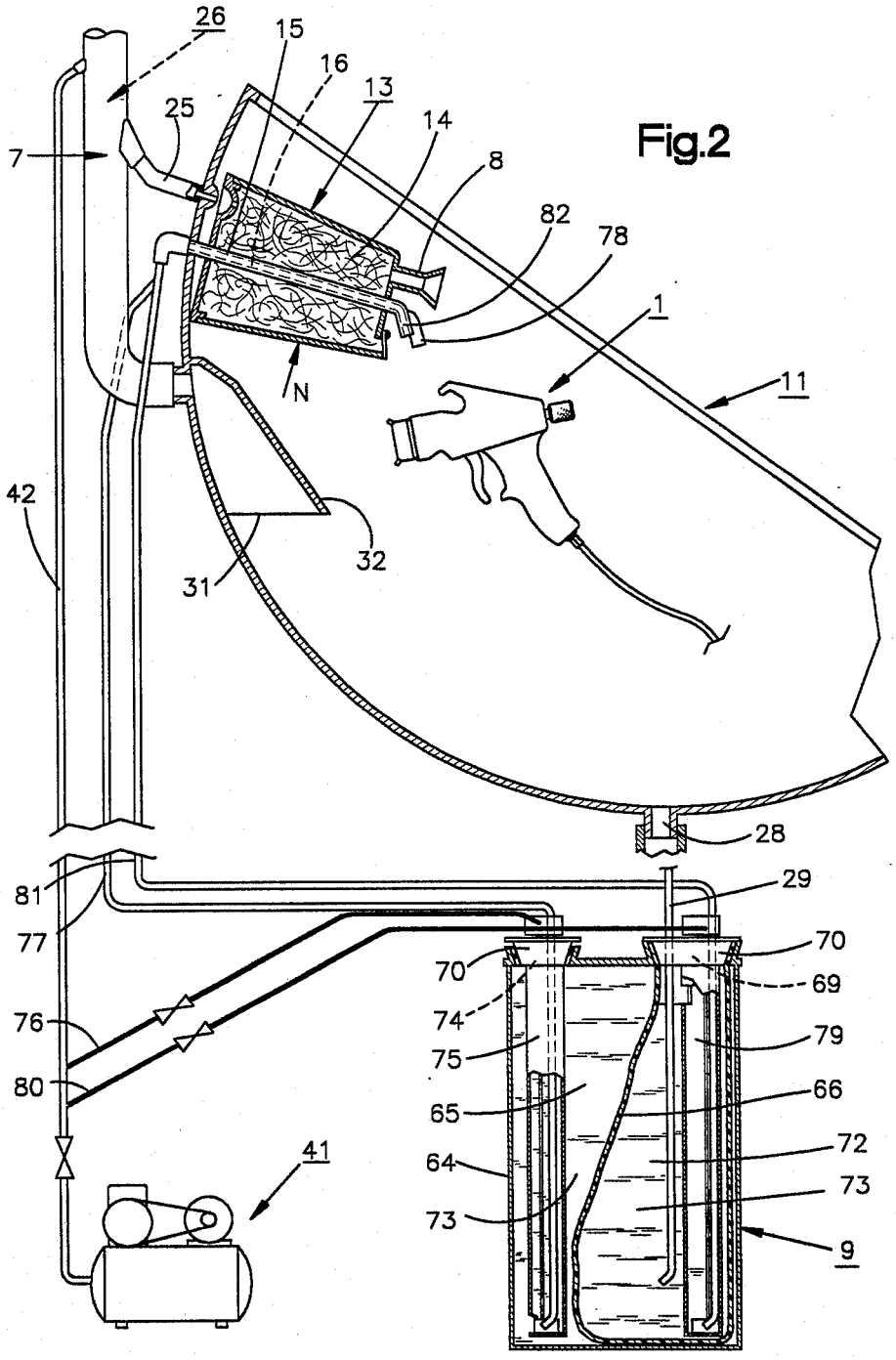
FIG. 2 shows the device with the container according to the invention before the start of the cleaning process.

The device illustrated in the drawings is intended for the cleaning of paint spray guns externally and also internally in the paint distributing passages 2 thereof, i.e. passages 2 adapted to conduct paint from a paint supply 3 to a paint delivery nozzle 5, said paint supply 3 being contained in a paint container 4 connectable to the spray gun 1. The paint distribution passages 2 are cleaned by removal of paint from said passages after the use of the spray gun 1 or when it is noticed that there is dried paint in said passages. Cleaning takes place by emptying the paint container 4 of paint possibly remaining therein and pouring detergent 6, preferably paint solvent of a suitable kind, thereinto. The paint container is then connected again to the spray gun 1 and solvent 6 is caused to flow through the paint distribution passages 2, dissolving paint from their walls and carrying said paint and other paint along and discharging the dissolved paint through the paint delivery nozzle 5. To realise this and collect the solvent 6 after it has cleaned the paint distribution passages 2 the device illustrated in the drawings comprises a suction system 7 in which a pressure below atmospheric prevails and which is provided with connecting means 8 to which the paint delivery nozzle 5 of the spray gun 1 is connectable or which is connectable to the paint delivery nozzle 5 of the spray gun 1 to suck with the aid of the pressure below atmospheric prevailing in the suction system 7 solvent 6 from the paint supply 3 through the paint distribution passages 2 and the paint delivery nozzle 5, a container 9 being arranged to collect solvent 6 sucked out of the spray gun 1.

Figure 3:
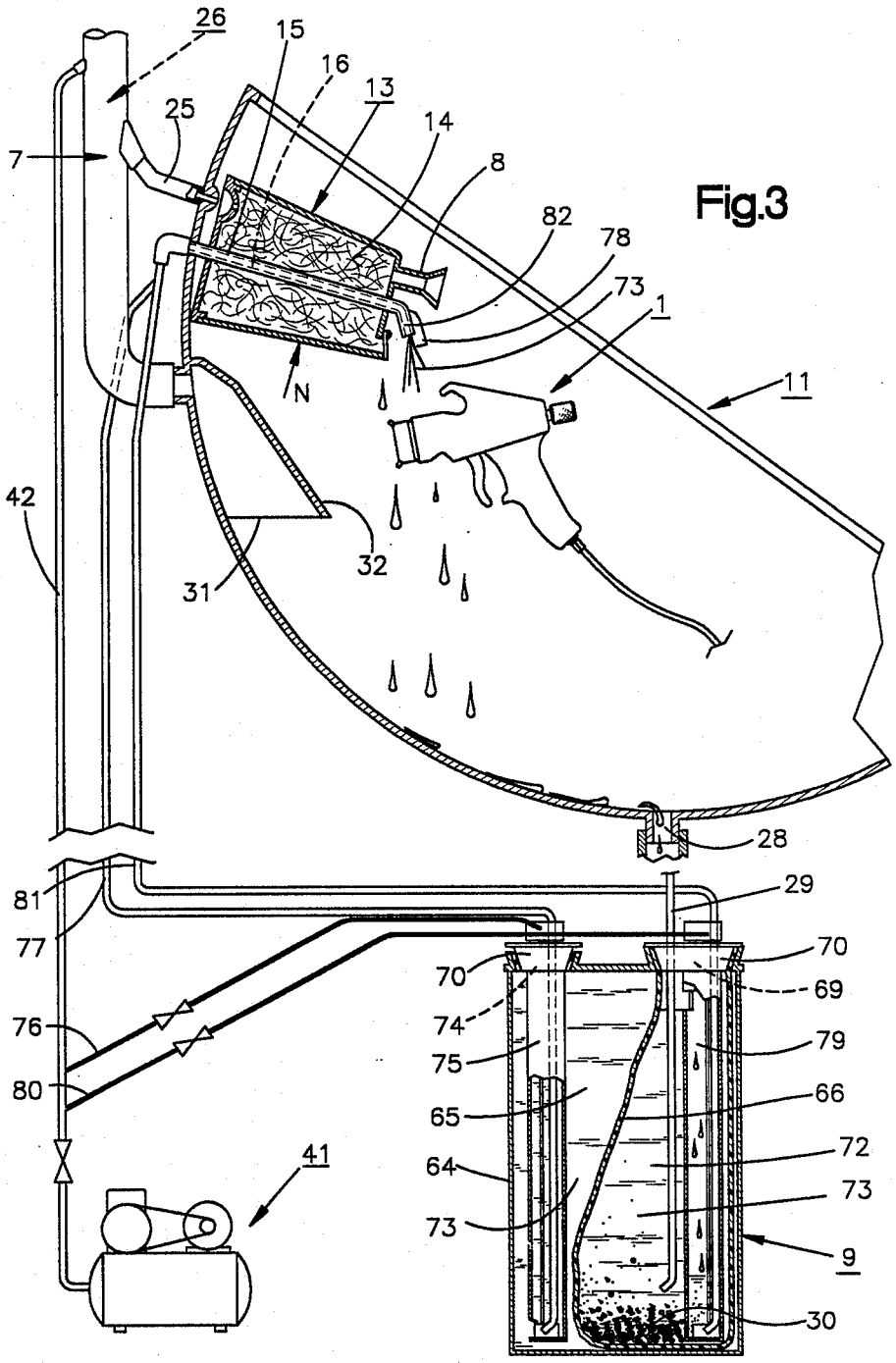
FIG. 3 shows the device with the container according to the invention during cleaning and collection of polluted detergent.

More precisely, the device providing the suction effect consists of a frame 10 with a flushing bowl 11 which at least on the inside is in the form of an upwardly open semisphere. At the top of the flushing bowl 11 is arranged a separating device 12 which is adapted to separate solvent 6 sucked out of the spray gun 1 from the air in the suction system 7 and to collect said separated solvent 6 whereby the latter is prevented from being sucked farther into the suction system 7. In this instance the separating device 12 has a collecting vessel 13 which is preferably filled with a suitable filter material 14 to separate the solvent 6 from an entering air/solvent mixture so that the solvent 6 is collected in the collecting vessel while the air is allowed to pass farther into the suction system 7. The collecting vessel 13 is slightly movably suspended in such a way in two juxtaposed pipes 15, 16 penetrating the wall of the flushing bowl 11 that in a normal position N it bears because of its weight with a lower corner against the flushing bowl 11. At the front and at an upper portion the collecting vessel 13 comprises the connecting means 8 intended for the connection of the paint delivery nozzle 5 of the spray gun 1, and at the front and at a lower portion said collecting vessel 13 comprises a drain valve 17 consisting of an opening and a valve member which is mounted on a screw and adapted to shut or open said opening. Besides, the collecting vessel 13 comprises, at the back and at an upper portion, a connecting means 21 having an opening 22. The flushing bowl 11 comprises a connecting means 23 having an opening 24 which via a conduit 25 communicates with a device 34 generating a pressure below atmospheric, being part of the suction system 7 and disposed in a venting passage 26 which is constituted int.al by a pipe 27. The connecting means 21 of the collecting vessel 13 does not connect onto the connecting means 23 of the flushing bowl 11 when the collecting vessel 13 is in the normal position N (FIG. 3), but the collecting vessel 13 is movably arranged on the pipes 15, 16 such that it can be tilted rearwards until its connecting meas 21 connects onto the connecting means 23 of the flushing vessel 11 and the opening 22 communicates with the opening 24. This rearward tilting of the collecting vessel 13 is brought about in that the paint delivery nozzle 5 of the spray gun 1 is applied against the collecting vessel 13 which is then tilted rearwards with the aid of the spray gun 1.

Figure 4:
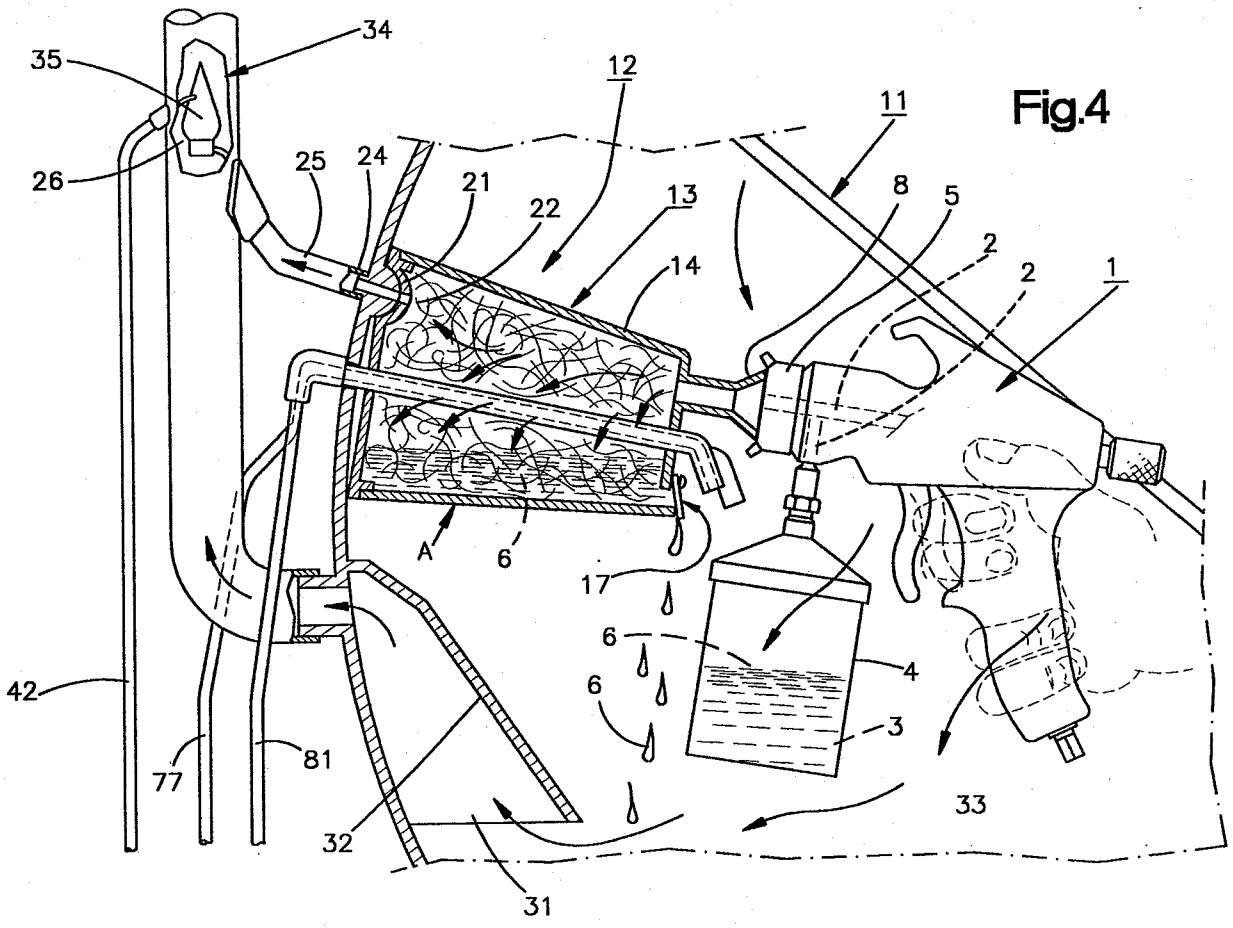
FIG. 4 shows the device during cleaning of the interior of the spray gun.
Figure 7:
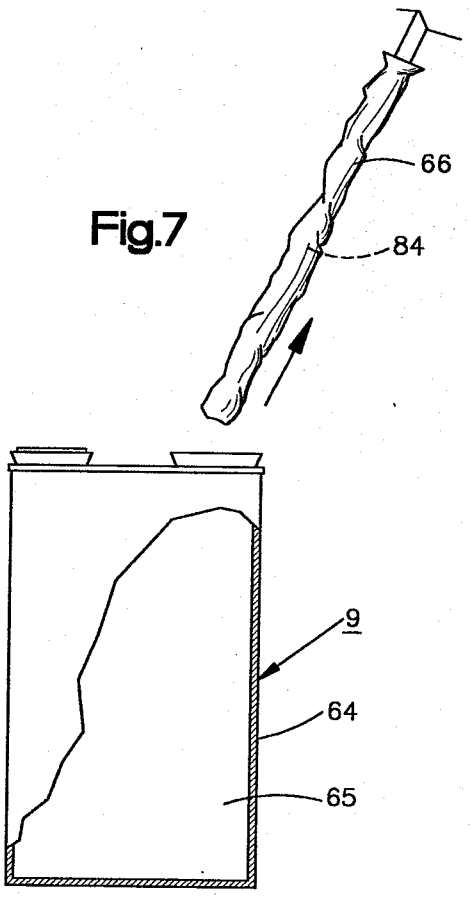
FIG. 7 shows how the inner container of the container is taken out of the outer container thereof.
Figure 6:
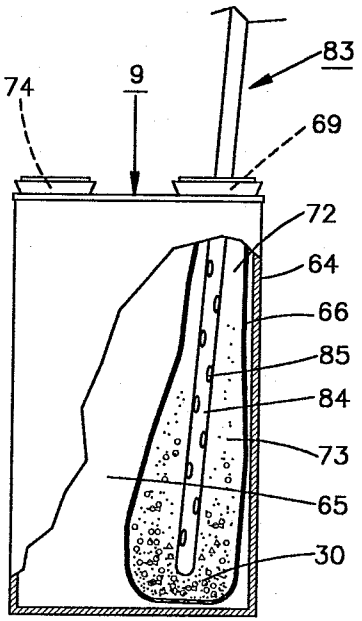
FIG. 6 is a side view of the container according to the invention during exhaustion of polluted detergent from the inner container thereof.
Figure 5:
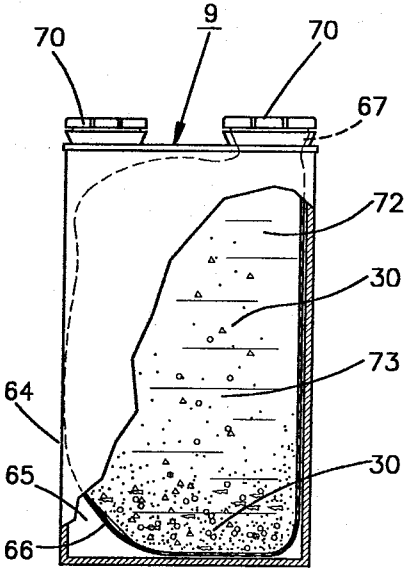
FIG. 5 shows the container according to the invention filled with polluted detergent.
Figure 8:
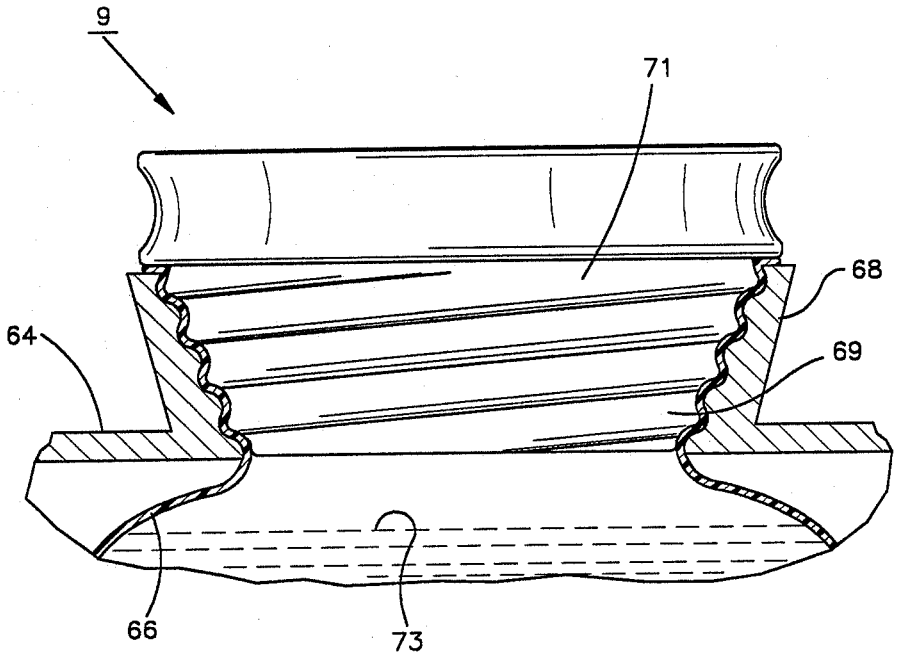
FIG. 8 is a section of a part of an element of the container according to the invention.

The separating device 12 operates in such a way that the spray gun 1 is connected to the connecting means 8 and the collecting vessel 13 is tilted rearwardly by urging said vessel rearwardly with the aid of the spray gun 1. The collecting vessel 13 will thereby be set in a position A (see FIG. 4) in which the interior of the collecting vessel 13 is connected to the conduit 25 and the device 34 disposed in the venting passage 26 and generating a pressure below atmospheric, implying that a pressure below atmospheric will prevail in the collecting vessel 13 and in the paint distribution passages 2 of the spray gun 1 connected to the connecting means 8. Owing to the pressure below atmospheric in said spaces, solvent 6 will be sucked from the paint container via the paint distribution passages 2, the paint delivery nozzle 5 and the connecting means 8 into the collecting vessel 13. The filter material 14 therein will ensure that the solvent 6 is separated from the entering air/solvent mixture and the separated solvent 6 will collect in the collecting vessel 13 during the cleaning operation since the pressure below atmospheric in the collecting vessel 13 results in that the valve member will keep the opening shut (see FIG. 4). After this separation the air substantially free of solvent will be sucked farther into the conduit 25.

Upon conclusion of the cleaning process the spray gun 1 is removed whereby the collecting vessel 13 reverts from its position of connection A to its normal position N, which implies that the connection between the interior of the collecting vessel 13 and the device 34 generating the pressure below atmospheric is broken. As a consequence, the pressure below atmospheric in the collecting vessel 13 will cease and the solvent 6 in the collecting vessel can escape through the opening 18 by moving the valve member 20 aside. The solvent 6 will flow into the flushing bowl 11 and, via a drain hole 28 and a conduit 29 connecting thereonto, down into the lower parts of the container 9, in which impurities 30 contained in the solvent 6 will collect.

The suction system 7 further has an air intake 31 in which a pressure below atmospheric is produced because said air intake is in communication with the venting passage 26. The air intake is formed by a suction hood 32 disposed in the flushing bowl 11 in such a manner that the air intake is able to suck up solvent vapours 33 that arise in the flushing bowl 11 when solvent 6 sucked out of the spray gun 1 flows down onto the flushing bowl 11 or when the spray gun and/or other implements (not shown) are flushed, preferably externally, with solvent 6 in the flushing bowl 71.

The device 34 producing a pressure below atmospheric in the venting passage 26 and the conduit 25 is preferably constituted by an ejector arrangement 35 which generates the pressure below atmospheric by producing strong air flows in the venting passage 26 and the conduit 25.

The container 9 consists of an outer container 64 preferably of rigid material, which has an inner space 65. An inner container 66 of flexible material, preferably plastic sheet material, is arranged to be placed, in a detachable manner, in the interior 65 of the outer container 64, with an upper part 67 engaging a collar 68 of the outer container 64. Said collar surrounds an opening 69 in the outer container 64 and is intended for fixation of a cap 70 or 71. By moving the cap 70 or 71 down into the collar 68 when the upper part 67 of the inner container engages the collar 68 and fixing the cap 70 or 71 thereto, for instance by screwing or clamping, the upper part 67 of the inner container 66 is clamped to the collar 68, which implies that the interior 72 of the inner container 66 is entirely separated from the interior 65 of the outer container 64.

The container 9 is filled entirely or at least to the greater part with clean detergent 73 of a suitable kind, e.g. paint solvent such as thinner, from a detergent tank, and approximately the same quantity of clean detergent 73 is filled into the interior 65 of the outer container 64 as into the interior 72 of the inner container 66. The total volume of clean detergent 73 in the container 9 is dependent upon whether as much solvent 73 as is withdrawn from the container 9 shall be collected in said container, or whether additional polluted detergent, for instance detergent 6 from the paint container 4 of the spray gun 1 shall be collected. In the latter case, capacity is reserved in the container 9 for the additional detergent 6, from the very beginning.

Upon completion of the filling of the container 9 with the requisite volume of clean detergent 73, the opening 69 and a further opening 74 leading to the interior 65 of the outer container 64 are closed by means of screw caps 71. After that, the container 9 is transported to the site where the detergent 73 is to be used, and the openings 69, 74 are opened by removal of their screw caps 71.

Through the opening 74 a pressure air operated pump 75 is passed into the interior 65 of the outer container 64. The pump 75 is driven by a compressor 41 via a conduit 76 and is intended to pump clean detergent 73 from the interior 65 of the outer container 64 via a conduit 77 to a flushing nozzle 78 in the flushing bowl 1. Hereby, the spray gun 1 or other implements or objects can be cleaned externally and/or internally with the aid of clean detergent 73.

Through the opening 69 a second pressure air operated pump 79 is passed into the interior 72 of the inner container 66. Said pump 79 is driven by the compressor 41 via a conduit 80 and is intended to pump clean detergent 73 from the upper part of the interior 74 of the inner container 66 via a conduit 81 to a flushing nozzle 82 in the flushing bowl 11. Hereby, the spray gun 1 or other implements or objects can be cleaned externally and/or internally with the aid of clean detergent 73 which is taken from the upper part of the interior 72 of the inner container 66.

In the flushing bowl 11 there is collected, in addition to detergent 73 from the collecting vessel 13, also detergent 73 from the flushing nozzles 78, 82, and the collected detergent 73 is conducted via the drain hole 28 and the conduit 29 into the lower part of the interior 72 of the inner container 66. The impurities 30 of the detergent 73 being heavier than the detergent 73, said impurities will remain in the lower parts of the interior 72, which implies that the pump 79 can suck up clean detergent 73 from the upper parts of the space 72 via an upper intake.

As the interior 65 of the outer container 64 is emptied of detergent 73 the interior 72 of the inner container 66 is filled while the walls of the inner container 66 unfold and/or distend. This may continue until the interior 65 of the outer container 64 is entirely or almost entirely emptied of detergent 73 and the inner container 66 is filled with detergent 73 while being unfolded and/or distended such that it entirely, or at least to the greater part, fills up the interior of the outer container 64.

The detergent may be considered too polluted for further cleaning when the detergent 73 withdrawn from the interior 72 of the inner container 66 by the pump 79 contains too large quantities of impurities 30. Usually, this may be established by the colour of the detergent 73. When the detergent 73 is too much polluted for further use, the pumps 75, 79 are removed from the outer and inner containers 64 and 66, the openings 69, 74 are closed by means of the caps 71 and the container 9 is removed from the frame 10 for transport to an installation in which the container 9 is emptied of polluted detergent 73. This can be done with the aid of an exhaust device 83 (not shown in detail) comprising a lance 84 with exhaust apertures spaced throughout its length. The lance 84 is lowered into the interior 72 of the inner container 66 and, by starting the exhaust device 83, the polluted detergent 73 is withdrawn from the inner container 66. The inner container 66 may possibly be sucked fast to the lance 84 and withdrawn together with the latter from the outer container 64. It is possible, however, to remove the inner container 66 in another manner, and said inner container can be replaced with a fresh and clean inner container or be cleaned and reused.

The container described above and illustrated in the drawings can be varied within the scope of the appendant claims as far as its shape and use is concerned. Thus, the outer container 64 may preferably consist of rigid or substantially rigid plastic or metallic material and the inner container 66 of flexible plastic material, such as plastic sheet material, or another material of sufficient flexibility. This material shall permit the inner container 66 to unfold and/or distend when filled with detergent until it fills up the entire or the greater part of the outer container 64, and the material may be of such a kind as to permit being destructed together with its contents. Instead of being half-full of detergent from the beginning, the inner container may be completely or almost empty from the beginning while the outer container is full or almost full of detergent.

Instead of pumping up detergent 73 from the inner spaces 65 and 72 of both the outer and the inner container 64 and 66, but one pump may be used to pump up detergent 73 only from the interior of 65 of the outer container 64 while the inner container 66 in this case only serves to collect detergent taken from the interior 65 of the outer container 64 and besides originating from somewhere else.

The pump or pumps may be of a type other than those shown and the detergent may be used for external and/or internal cleaning of implements or objects other than spray guns. Furthermore, the detergent may be a solvent or any other agent in liquid form having hazardous and/or explosive properties.

I claim:

1. An apparatus for use in cleaning polluted implements with a hazardous detergent, preferably a solvent, said apparatus comprising an outer container having an inner space for containing clean detergent, a pump device for pumping clean detergent from the inner space of said outer container toward a use location, and an inner container located within the inner space of said outer container, said inner container having an inner space for receiving the detergent withdrawn from said outer container and polluted through its use at the use location and an opening through which the polluted detergent flows into the inner space of said inner container from the use location, said inner container having walls made of a flexible material for enabling said inner container to expand upon being filled with polluted detergent.

2. An apparatus as claimed in claim 1 further including locating means for detachably locating said inner container within said outer container.

3. An apparatus as claimed in claim 2 wherein said locating means comprises a collar defining an opening in said outer container and a cap for closing said opening, said inner container having an upper portion received within said collar and clamped between said collar and said cap.

4. An apparatus as claimed in claim 1 wherein the inner space of said inner container is for receiving clean detergent, and said container comprises a second pump device for pumping clean apparatus from the inner space of said inner container toward the use location.

5. An apparatus as claimed in claim 4 further comprising a conduit for flowing of the polluted detergent into the inner space of said inner container and extending through said opening in said inner container through which the polluted detergent for the use location flows thereinto said conduit extending to a portion of the inner space of said inner container located adjacent the bottom thereof, said outer and inner containers being filled with clean detergent preferably to about half of their capacity and preferably with about equal volumes of clean detergent upon delivery to the use location.

6. A container as claimed in claim 1 wherein the shape and the size of said inner container in an expanded condition thereof correspond substantially to the shape and size of the inner space of said outer container.

7. An apparatus as claimed in claim 1 further comprising an exhaust device for withdrawing the polluted detergent from the inner space of said inner container.

8. An apparatus as claimed in claim 7 wherein said exhaust device comprises a lance member receivable in the inner space of said inner container, said lance member having a plurality of openings spaced throughout the length thereof, the flexible material from which said walls of said inner container is made enabling said walls to be sucked fast to said lance member and thereby enabling withdrawal of said inner container from the inner space of said outer container when said lance member is withdrawn.

* * * * *